United States Patent [19]

Piccagli

[11] 4,453,366

[45] Jun. 12, 1984

[54] PROCESS OF FORMING A CONTINUOUS WALL IN THE GROUND

[76] Inventor: Ugo Piccagli, 4511 Harry's La., Dallas, Tex. 75229

[21] Appl. No.: 471,729

[22] Filed: Mar. 3, 1983

[51] Int. Cl.[3] ..... E04B 1/00; E02D 27/00

[52] U.S. Cl. ..... 52/742; 52/744; 52/169.14; 405/267

[58] Field of Search ..... 52/169.1, 169.14, 742, 52/743, 744; 405/267, 152

[56] References Cited

U.S. PATENT DOCUMENTS

| | | | |
|---|---|---|---|
| 1,628,933 | 5/1927 | Troiel | 52/742 |
| 2,277,286 | 3/1942 | Bechtner | 52/169.14 |
| 3,407,552 | 10/1968 | Cassidy | 52/742 |
| 3,449,879 | 6/1969 | Bloom | 52/744 |
| 3,645,101 | 2/1972 | Sherard | 405/267 |
| 3,759,044 | 9/1973 | Caron et al. | 405/267 |
| 4,193,716 | 3/1980 | Piccagli | 405/267 |

FOREIGN PATENT DOCUMENTS

| | | | |
|---|---|---|---|
| 186342 | 7/1951 | France | 52/743 |

*Primary Examiner*—John E. Murtagh
*Assistant Examiner*—Andrew Joseph Rudy
*Attorney, Agent, or Firm*—Larson and Taylor

[57] ABSTRACT

A method of constructing an impermeable wall in the ground is disclosed. The method utilizes prefabricated panels and does not require the same thickness of wall as normally has to be cast in a trench. The method comprises the steps of excavating a trench having a defined width, replacing excavated material with bentonite water slurry, placing interlocking, prefabricated concrete panels in the trench, the panels having a thickness less than the width of the trench, one side of the panels resting against one side of the trench, placing guides in the trench between the other side of the panels and the other side of the trench to hold the panels upright and against the one side of the trench, pouring concrete by tremie pipe in the bottom of the trench for a predetermined height replacing some of the bentonite water slurry, grouting joints between adjacent panels to ensure a waterproof seal, after the concrete and grouting has hardened, back filling remainder of the trench with selected material replacing most of the remaining bentonite water slurry and mixing with a small amount of the slurry, and packing the selected material well down to form an impermeable wall.

7 Claims, 4 Drawing Figures

PROCESS OF FORMING A CONTINUOUS WALL IN THE GROUND

The present invention relates to a method of constructing an impermeable wall in the ground. More particularly, the present invention relates to a method of constructing a continuous impermeable wall in the ground, including digging a trench and installing a series of preformed panels which interlock one with the other, the trench being considerably wider than the thickness of the panels.

The method of digging a trench in the ground by replacing the excavated earth with a liquid formed of thixotropic clay in suspension, referred to as bentonite, is known. The bentonite water slurry prevents the walls of the trench from collapsing during the excavating step. One example of forming a wall with a continuous trench is shown in my U.S. Pat. No. 4,193,716 which issued Mar. 18, 1980. In this patent, a continuous trench is dug with bentonite water slurry and after completing the excavation, some of the bentonite water slurry is replaced with cement and mixed to produce a cement bentonite water slurry. The slurry is allowed to harden and form an impermeable wall.

Whereas this system is effective, it requires the wall to be the same thickness as the trench, and it is sometimes necessary to dig a trench wider than is really necessary for the strength of a wall, thus an excess amount of cement is needed for such a construction.

The present invention provides an impermeable wall in the ground which utilizes interlocking prefabricated concrete panels in a trench, the thickness of the panels being approximately half the width of the trench. Thus, less concrete is required for a wall than that disclosed in my previous patent.

The present invention provides a method of constructing an impermeable wall in the ground comprising the steps of: excavating a trench having a defined width in the ground, replacing excavated material from the trench with bentonite water slurry, placing interlocking prefabricated concrete panels in the trench, the panels having a thickness less than the width of the trench, one side of the panels resting against one side of the trench, placing guides in the trench between the other side of the panels and the other side of the trench, to hold the panels upright and against the one side of the trench, pouring concrete by tremie pipe in the bottom of the trench for a predetermined height replacing some of the bentonite water slurry, grouting joints between adjacent panels to ensure a waterproof seal, after the concrete and the grouting has hardened back filling remainder of the trench with selected material replacing most of the remaining bentonite water slurry and mixing the selected material with a small amount of the slurry, and packing the selected material well down to form an impermeable wall.

The present invention also provides that the thickness of the panels is approximately half the width of the trench. In another embodiment the thickness of the panels is in the range of about one foot to one foot six inches and the width of the trench is in the range of about two to three feet. The predetermined height of concrete in the bottom of the trench is preferably about three feet.

In another embodiment, the joints between the interlocking panels have a space between adjacent panels and the grouting step includes pumping heavy grouting into the space through a plastic pipe. In a still further embodiment the selected back fill is selected from the group consisting of sand, gravel and a mixture of sand and gravel.

In a still further embodiment of the invention, a join section is utilized at one end of the trench when the trench is excavated in more than one length, the joint section extending across the width of the trench and having an interlocking connection to join to an end panel in the trench, the join section being removed before a next length of the trench is excavated.

In drawings which illustrate the embodiments of the invention,

Figure 1:
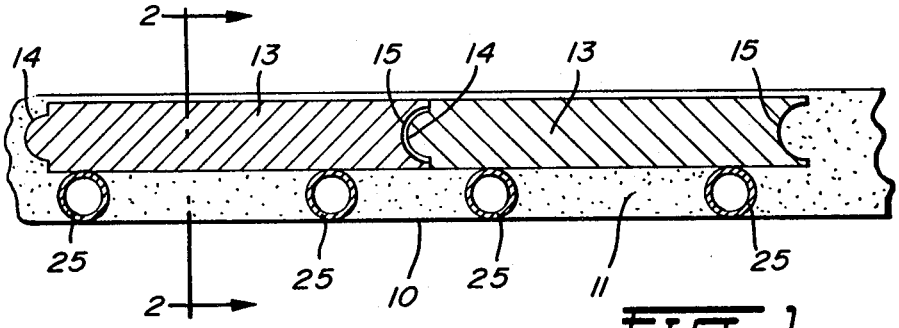
FIG. 1 is a top plan view, showing two panels located in a trench and supported by means of guides.
Figure 2:
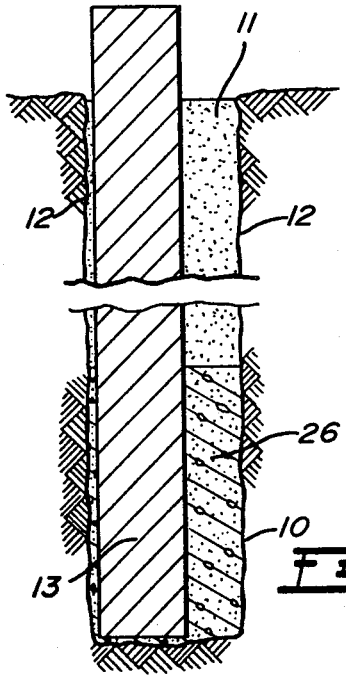
FIG. 2 is a vertical section taken at line 2—2 of FIG. 1.

Referring now to the drawings, a trench 10 is shown in FIGS. 1 and 2 dug in the ground 11 by means of a back hoe or other trenching tool, and filled with a bentonite water slurry to prevent the walls 12 of the trench 10 collapsing. When the trench has been dug to its required depth, prefabricated panels 13 are positioned in the trench up against one side 12 thereof. Each of the panels 13 has connecting ends, a concave end 15, and a convex end 14. The convex end 14 of one panel fits into the concave end 15 of the adjacent panel to form a joint. As is illustrated in more detail in FIG. 3 the diameter of the convex protrusion 20 is considerably less than the diameter of the concave groove 21, which permits a fair amount of lateral movement in the joint so that the panels do not have to be accurately aligned. A space 22 between the convex protrusion 20 and the concave groove 21 allows for grouting in the joint to provide a seal.

In order to hold the panels 13 in place against one side 12 of the trench 10, guides 25 are lowered into the trench between the surface of the panel 13 and the other side 12 of the trench 10. In the example shown in FIG. 1 the guides 25 are tubes or pipes, however, these could be square, rectangular or be formed of I-beam or channel section. The shape of the guide is not important provided it holds the panel 13 vertical up against one side 12 of the trench 10.

The panels 13 are prefabricated concrete, preferably in the range of 12–18 inches in thickness, and are generally reinforced. The trench is preferably about twice the width of the panel thickness in the range of two feet to three feet.

Concrete is then poured by means of tremie pipe into the bottom of the trench 10. A tremie pipe comprises a vertical pipe extending down to very nearly the bottom of the trench and concrete is poured through this pipe so that the concrete exists at the bottom of the trench and replaces the bentonite water slurry 11. The concrete is poured until it reaches the predetermined height in the trench. This height is preferably about three feet. The concrete rises on both sides of the panel 13 forming a concrete pad 26, acting as a footing for the panel 13. The concrete is allowed to harden to completely support the panel 13. As the concrete hardens, the guides 25 are removed, ensuring that the panels 13 do not tilt or otherwise move in the trench. The concrete pad 26 provides load bearing capacity for the panels 13 and also ensures that these panels are rigidly supported in the trench.

Figure 3:
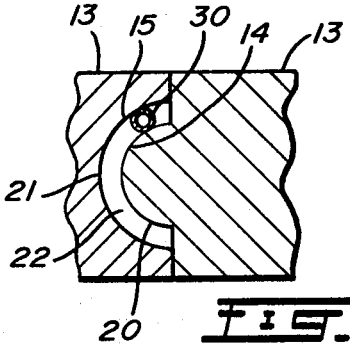
FIG. 3 is a partial plan view showing a joint between adjacent panels.

The joints between panels 13 are then grouted by inserting a small plastic pipe 30 as shown in FIG. 3 into the space 22 between the groove 21 and the projection 20. The pipe 30 has a heavy grout pumped down it under pressure, so that it exists from the bottom of the pipe at the bottom of the space 22. The pipe 30 is then slowly withdrawn as the grout is pumped into this space 22 until the grout comes to the top of the panel. When the grout hardens, it forms a waterproof seal at the joint. It is preferable that the grout be pumped into this space 22 under pressure to ensure that it fills up all the space 22 and if a gap exists between the ends of the panels 13, the grout is forced out to fill this space. The pipe 30 is preferably a plastic pipe which can easily be withdrawn after the space 22 has been filled with grout.

After the grout and the concrete forming the pad 26 has hardened, then the remaining space of the trench is filled in with a back-fill replacing most of the bentonite water slurry 11 therein. The back-fill is preferably gravel, sand or a mixture of these two, and some bentonite water slurry remains in the trench to mix with this back-fill which is then packed into the trench so that the mixture of back-fill and bentonite water slurry forms an impermeable wall against the panels 13. Most of the bentonite water slurry 11 is displaced, leaving only a small quantity to mix with the back-fill. The resulting wall is an impermeable wall which may be excavated on the panel side as desired. The trench 10 may be dug for the required length or may be dug in sections, and the panels inserted for a predetermined length of trench.

Figure 4:
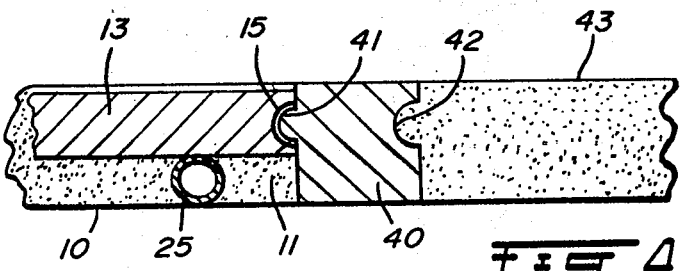
FIG. 4 is a top plan view showing how a joint is formed in a trench.

When a long wall is required, it is necessary to dig the trench in sections. When this is done a special joint section 40 as shown in FIG. 4 is used. The join section 40 has a substantially square cross section. As illustrated it appears to be solid, but is most often hollow and may be formed of steel plate or sections as it is reuseable. The join section 40 has the same width as the trench, and therefore fills up the end of the trench providing a support for the last panel 13 in the wall and to allow the continuity of the trench for the next length of trench to be dug. The join section 40 has an interlocking convex end connection 41 to join with the concave end 15 of the last panel. An interlocking concave end connection 42 is provided on the other side of the section 40 for using at the other end of a wall. The joint section 40 remains in place while the first length of wall is being made, and is removed before a second trench 43 is dug extending on from the joint section 40 for a second length of wall. The joint section 40 is lifted out of the trench 10 after the prefabricated panels are positioned in the trench and after concrete is poured by means of a tremie pipe into the bottom of the trench.

Various changes may be made to the scope of the present invention which is limited only by the following claims.

The embodiments of the invention in which an exclusive property or privilege is claimed are defined as follows:

1. A method of constructing an impermeable wall in the ground, comprising the steps of:

excavating a trench having a defined width in the ground, replacing excavated material from the trench with bentonite water slurry, placing interlocking, prefabricated concrete panels in the trench, the panels having a thickness less than the width of the trench, one side of the panels resting against one side of the trench, placing guides in the trench between the other side of the panels and the other side of the trench to hold the panels upright and against the one side of the trench, pouring concrete by tremie pipe in the bottom of the trench for a predetermined height replacing some of the bentonite water slurry, grouting joints between adjacent panels to ensure a waterproof seal, after the concrete and grouting has hardened back-filling remainder of the trench with selected material replacing most of the remaining bentonite water slurry and mixing with a small amount of the slurry, and packing the selected material well down to form an impermeable wall.

2. The method according to claim 1 wherein the thickness of the panels is approximately half the width of the trench.

3. The method according to claim 1 wherein the thickness of the panels is in the range of about one foot to one foot six inches and the width of the trench is in the range of about two feet to three feet.

4. The method according to claim 1 wherein the predetermined height of concrete in the bottom of the trench is about three feet.

5. The method according to claim 1 wherein the joints between the interlocking panels have a space between adjacent panels and the grouting step includes pumping heavy grouting into the space through a plastic pipe.

6. The method according to claim 1 wherein the selected back-fill is selected from the group consisting of sand, gravel and a mixture of sand and gravel.

7. The method according to claim 1 wherein a joint section is utilized at one end of the trench when the trench is excavated in more than one length, the join section extending across the width of the trench and having an interlocking connection to join to an end panel in the trench, the join section being removed before a next length of the trench is excavated.

* * * * *